United States Patent [19]

Ritland et al.

[11] 4,175,469

[45] Nov. 27, 1979

[54] CENTRIFUGAL AEROSOL DISPENSER ASSEMBLY

[75] Inventors: Harold N. Ritland, Bellevue; George H. Thacker, Kent, both of Wash.

[73] Assignee: The United States of America as represented by the Secretary of the Air Force, Washington, D.C.

[21] Appl. No.: 882,526

[22] Filed: Mar. 1, 1978

[51] Int. Cl.[2] ..... F11F 5/02; F42B 13/50

[52] U.S. Cl. ..... 89/1 B; 102/89 CD; 343/18 E

[58] Field of Search ..... 102/89 CD, 34.4, 35.6, 102/37.6; 89/1.819, 1 B; 343/18 E

[56] References Cited

U.S. PATENT DOCUMENTS

| | | | |
|---|---|---|---|
| 2,871,344 | 1/1959 | Busignies | 343/5 R |
| 3,064,575 | 11/1962 | Schermuly | 102/89 CD X |
| 3,095,814 | 7/1963 | Jansen et al. | 102/89 CD X |
| 3,143,965 | 8/1964 | La Pointe | 102/34.4 |
| 3,222,675 | 12/1965 | Schwartz | 102/34.4 X |
| 3,730,098 | 5/1973 | Edwards | 102/89 CD X |
| 3,898,661 | 8/1975 | Kelly et al. | 343/18 E |
| 3,899,975 | 8/1975 | Lawrence | 102/34.4 X |
| 3,983,783 | 10/1976 | Maxey | 89/1.819 X |
| 4,063,515 | 12/1977 | Schneider et al. | 102/89 CD |

*Primary Examiner*—David H. Brown

*Attorney, Agent, or Firm*—Joseph E. Rusz; Jacob N. Erlich

[57] ABSTRACT

A centrifugal aerosol dispenser assembly capable of dispersing a cloud of particulate aerosol material in a predetermined geometrical configuration. The dispenser assembly is formed of two parts, a mount and a dispenser. An ejector mechanism having a portion thereof on said mount and a portion thereof on said dispenser expels the dispenser from said mount with a spin motion. A plurality of dispensing compartments located within the dispenser contains the particulate material therein, and, at a predetermined time after ejection thereof releases its contents in a predetermined geometrical configuration due to the centrifugal forces acting thereon.

10 Claims, 4 Drawing Figures

CENTRIFUGAL AEROSOL DISPENSER ASSEMBLY

STATEMENT OF GOVERNMENT INTEREST

The invention described herein may be manufactured and used by or for the United States Government for governmental purposes without payment of any royalty thereon.

BACKGROUND OF THE INVENTION

This invention relates generally to dispensers, and, more particularly to an aerosol dispenser assembly capable of controlled, low velocity dispersal of particulate aerosol materials by centrifugal force.

There are numerous fields in which it is desirable to dispense particulate aerosol materials into the atmosphere at a preselected time and place. For example, since the advent of radar, it has been known that small metallic particles dispensed in the atmosphere in a cloud are visible to radar detectors and tend to mask or obscure the presence of targets in or on the far side of the cloud. Such particles are generally placed in a dispenser and when airborn, at a preselected time, the dispenser is opened to discharge the deflecting material. A common technique for ejecting these particles is to place the material within a container and on top of a gas generating pyrotechnic. At the proper time the pyrotechnic is ignited and the gas generated thereby expels the particles from the container. While this appears to be a simple and technically feasible approach to the problem it has not worked satisfactorily. Gas generating dispensers are in many cases unreliable in operation and furthermore under some circumstances damage the particles themselves.

Also, in recent years the subject of radio propagation by scattering processes has become of great theoretical and practical importance. The discoveries that V.H.F., U.H.F., and S.H.F. signals are propagated to distances well beyond the horizon with losses much less than are predicted by diffraction theory and with high reliability have made possible the design of reliable point-to-point communication systems to operate over distances of 200 miles or more beyond the horizon. The systems employ high gain antennas, high power transmitters and space diversity reception. The cost of such equipment is justified in many applications because the need for intermediate repeater stations is obviated.

In beyond-the-horizon transmission, the reflective scattering of the electromagnetic wave depends upon the reflective characteristics of a natural layer of electrified particles found in the upper atmosphere. As is known, the characteristics of these layers vary and, hence, communication utilizing such layers tends to be erratic. Also, the signal-to-noise ratio of the overall communication system may vary and generally the ratio is lower than desirable even though communication is possible.

It is therefore desirable to create an artificial layer of electromagnetic wave reflective scattering material in a given zone of the upper atmosphere. An electromagnetic wave beam from a transmitter incident on the artificial layer at a given angle is caused to be reflectively scattered earthward toward a receiver spaced from said transmitter and adapted to receive the scattered electromagnetic energy of the beam.

Means to disperse the above reflecting material in the desired zone of the upper atmosphere included guns and the like, aircraft including guided missiles, ballons, rockets and the expelling of an ionized gas in the exhaust of such aircraft. Unfortunately, the prior art attempts at material scattering left much to be desired in reliability and reproducability.

A new area for the utilization of particle dispersement is in the field of optical communication in which these particles, sized to a particular wavelength of interest are dispersed into the exoatmosphere. The dispensing means in this field has generally taken the form of tubular or elliptical frangible glass vials to produce clouds of aerosols which would have a low growth rate. The vials were fractured at both ends by mechanical means in order to provide a linear dispersal of the particles. This technique, however, is unable to reproducibly create a cloud with low expansion velocity. Furthermore, the frangible glass vial, when broken, cannot reliably produce an aerosol cloud of known geometric shape or density.

Clearly a great need has arisen for a dispenser which is capable of reliably and reproducibly dispersing particulate aerosol materials into the atmosphere or above.

SUMMARY OF THE INVENTION

The centrifugal aerosol dispenser assembly of this invention overcomes the problems set forth in detail hereinabove by dispersing in a predictable and reliable manner particulate aerosol materials (such as powder).

The dispenser assembly of the instant invention is made up of a mounting platform and a dispenser. At least one dispenser compartment is operatively attached within the dispenser. The dispenser is removably mounted upon the platform which may form part of, for example, an aircraft, missile or the like.

Upon separation from a parent vehicle by means of a quick ejection mechanism, the dispenser of this invention is spun at a low rate by means of a pin and rifle groove arrangement. At some time following separation a battery driven timer sends a signal to an actuator located in the dispenser compartment which release constraints holding sectioned spring steel sides packed with the aerosol material, in place. Following removal of the sides the aerosol is formed from the confines of the dispenser compartment and drift outward with a velocity $v=rw$, where r is the radius describing the particle position and w is the angular velocity of the assembly. Fins or other obstacles can be added to the assembly to alter the geometrical shape of the aerosol cloud. More than one cloud of aerosol material can be dispensed by the basic mechanism of the inventions by the addition thereto of a plurality of dispenser compartments.

It is therefore an object of this invention to provide an aerosol dispenser assembly which relies upon centrifugal force for the dispersion of particulate materials.

It is another object of this invention to provide a centrifugal aerosol dispenser assembly which disperses particulate aerosol materials at predictable and reproducible low velocities.

It is a further object of this invention to provide a centrifugal aerosol dispenser assembly which is economical to produce and which utilizes conventional, currently available components that lend themselves to standard mass producing manufacturing techniques.

For a better understanding of the present invention, together with other and further objects thereof, reference is made to the following description taken in conjunction with the accompanying drawings and its scope will be pointed in the appended claims.

DETAILED DESCRIPTION OF THE DRAWING

DETAILED DESCRIPTION OF THE PREFERRED EMBODIMENT

Figure 1:
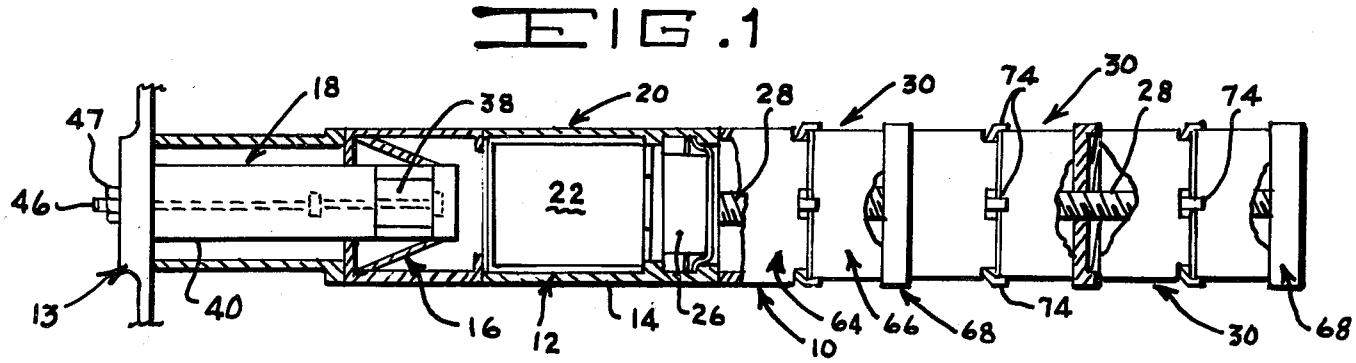
FIG. 1 represents a segmented side elevational view of the centrifugal aerosol dispenser assembly of this invention, shown partly in cross-section.

Reference is now made to FIG. 1 of the drawing which describes the centrifugal aerosol dispenser assembly 10 of this invention. Dispenser assembly 10 is made up of ejectable dispenser 12 operatively connected to a mounting platform 13. Dispenser 12 is in the form of an elongated body 14, preferably of cylindrical configuration, formed of a plurality of sections or compartments secured together in a manner to be described in detail hereinbelow. Mounting platform 13 is secured within or forms an integrated part of a conventional transporting parent vehicle, such as an aircraft or missile, capable of carrying dispenser 12 to its desired location within, for example, the exoatmosphere.

Elongated body 14 of dispenser 12 contains a base compartment 16 having a portion of ejection mechanism 18 formed as a part thereof. The remaining portion of ejection mechanism 18 is secured to or formed as an integral part of platform 13. A detailed description of ejection mechanism 18 will be set forth hereinbelow in conjunction with FIG. 2 of the drawing.

Located adjacent base compartment 16 and attached thereto or formed as an integral part thereof is a power compartment 20 which houses a conventional power source such as battery 22. Situated adjacent power compartment 20 and connected thereto or formed as an integral part therewith is any conventional electrical timer 26.

Centrally secured to power compartment 20 is an elongated, hollow, externally threaded shaft 28. Shaft 28 runs the entire length of dispenser 12. Mounted upon shaft 28 in a manner to be described hereinbelow with respect to FIG. 3 of the drawing are a plurality of dispenser compartments 30. Also located within shaft 28 are any electrical connectors such as wiring 32 necessary for operatively connecting timer 26 to a conventional actuator mechanism 72 shown clearly in FIG. 3 of the drawing and located within each dispenser compartment 30.

Figure 2:
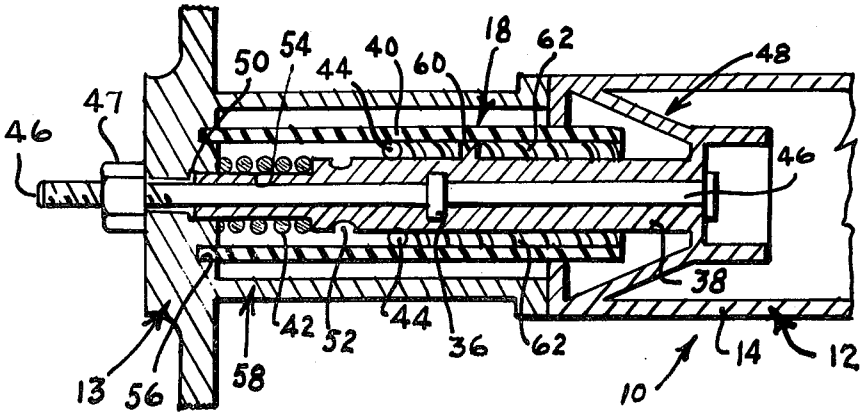
FIG. 2 is a detailed side elevational view of the ejection mechanism of the centrifugal aerosol dispenser assembly of this invention, shown partly in cross-section.

Reference is now made to FIG. 2 of the drawing which clearly illustrates the ejection mechanism 18 of aerosol dispenser assembly 10 of this invention. Ejection mechanism 18 is made up primarily of a conventional explosive squib 36, an inner sleeve 38, an outer sleeve 40, spring 42, aligning balls 44, bolt 46 and ejector housing 48.

Inner sleeve 38 surrounds bolt 46 and is mechanically attached to the ejector housing 48 at the base (e.g., machined from the same piece or otherwise attached). The other end of sleeve 38 is held in a machined groove 50 at the forward end of platform 13. Sleeve 38 is characterized by detents 52 into which guiding balls 44 will fit and an area 54 of reduced diameter over which spring 42 is fitted.

Outer sleeve 40 is fabricated of a semi-rigid material, preferably elastomer, and is physically attached at the base thereof within groove 56 of platform 13. The forward end of sleeve 40 rides freely adjacent the base of inner sleeve 38. Attachment bolt 46 is located within inner sleeve 38, being secured between housing 48 and platform 13 by nut 47. Bolt 46, upon the tightening thereof, is utilized to move inner sleeve 38 in the direction of platform 13 in order to compress spring 42.

The ejection mechanism 18 is made of two sections, a base section 58 including outer sleeve 40 which remains with platform 13 following ejection of aerosol dispenser 12 and ejector housing 48 which is ejected with dispenser 12 in a manner to be set forth in detail hereinbelow. In addition, ejection mechanism 18 incorporates therein means for imparting spin motion, with resulting centrifugal force, to dispenser 12 of this invention following ejection thereof. This spin motion is accomplished by the mating engagement between a pin 60 formed as a part of inner sleeve 38 and a rifled or spiral groove 62 located in the inner periphery of outer sleeve 40. As dispenser 12 is ejected, pin 60 slides through rifled groove 62 in sleeve 40 imparting appropriate spin motion to forward housing 48. As a direct consequence thereof dispenser 12 is also imparted a spin as it is ejected from platform 13.

Ejection of dispenser 12 of the instant invention takes place upon the initiation of conventional explosive squib 36 or the like which is operatively connected to bolt 46. Upon detonation thereof, bolt 46 is fractured and spring 42 exerts a pressure or force against inner sleeve 38 in order to expel forward housing 48. During this procedure the sliding relationship between pin 60 and groove 62 provides the desired spin motion to the ejected dispenser 12.

Referring once again to FIG. 1 of the drawing, located adjacent forward housing 48 of dispenser 12 is power compartment 20. Encased within compartment 20 is a conventional electrical timer 26 powered by any conventional power source such as a battery 22. If desired, however, timer 26 may be mechanical and battery 22 can be therefore eliminated. The activation of battery 22 and timer 26 result from the operation of any conventional microswitch or mechanical switch (not shown) as dispenser 12 leaves mounting platform 13. The time is preset at time of aerosol dispenser assembly to the time delay desired between dispenser ejection and aerosol dispersal.

Figure 3:
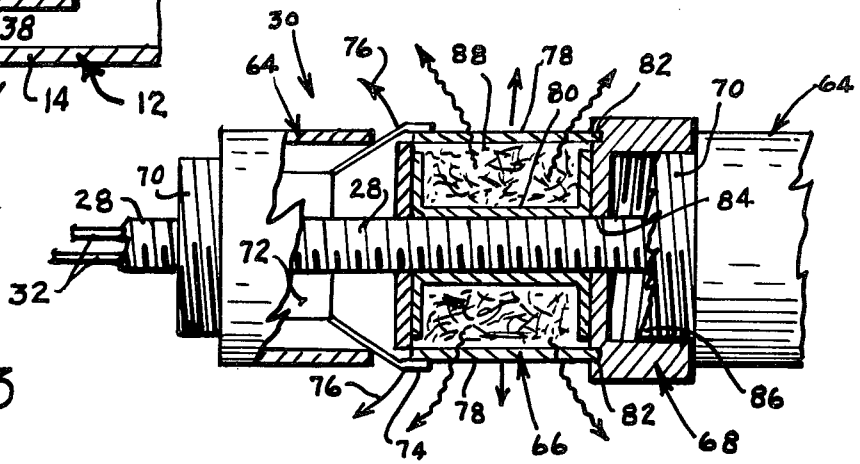
FIG. 3 is a detailed side elevational view of the dispenser compartment of the centrifugal aerosol dispenser assembly of this invention, shown partly in cross-section.

Reference is now made to FIGS. 1 and 3 of the drawing which clearly describes the dispenser compartments 30. Although this invention is capable of operation with only one such compartment 30, it is preferable for dispenser 12 to contain at least three dispenser compartments 30 as shown in FIG. 1.

Each dispenser compartment 30 is made up of two section, a base or actuator section 64 and a dispensing section 66, and a cover 68. As seen from FIG. 3 of the drawing actuator section 64 is of a substantially cylindrical configuration having an externally threaded section 70 of reduced diameter at the base thereof and any conventional actuating mechanism 72 centrally disposed therein. Actuating mechanism 72 is electrically coupled to wires 32 in a conventional manner (not shown) not forming a part of the instant invention. The power for the operation of actuating mechanism comes from battery 22 regulated by timer 26 or may be in the form of a mechanical spring operated device activated by timer 26. Upon activation thereof, a plurality of actuator locking arms 74 move in the direction of arrows 76 and release sides 78 of dispensing section 66 in a manner to be set forth hereinbelow.

Mounted adjacent actuator section 64 is dispensing section 66. Dispensing section 66 is made up of a spool like housing 80 slidably mounted upon shaft 28. The sides 78 of dispensing section 66 are made of a plurality of sections of spring steel or beryllium-copper material, held in place at one end thereof by actuator locking arms 74 and at the other end thereof by grooves 82 formed within cover 68. When released by the removal of locking arms 74, sides 78 spring away from dispenser compartment 30.

Before the enclosing of dispensing section 66 by positioning cover 68 in place over sides 78, any suitable particulate aerosol material such as powder 88 is placed within the interior of section 66.

Cover 68, which has an internally threaded centrally located aperture 84, screws in place on shaft 28 in order to secure sides 78 firmly in position until release thereof. In addition to aperture 84, cover 68 also has a larger cylindrically-shaped internally threaded portion 86 therein for receiving the threaded base 70 of an additional dispensing compartment 30. If no further compartments 30 are necessary, cover 68 may omit portion 86 and be made of a solid piece of material containing only threaded aperture 84.

In operation, dispenser assembly 10 of this invention forms part of a transporting or parent vehicle (not shown). Platform 13 of dispenser assembly 10 may be either an integral part of such a vehicle or securely affixed thereto by conventional means. At the appropriate time and at the appropriate destination explosive squib 36 is detonated. This detonation fractures bolt 46 and allows spring 42 to propel dispenser 12 away from platform 13. Under the influence of spring 42 and because of the relationship between pin 60 and grooves 62 in outer sleeve 40, dispenser 10 is given a spin motion.

Figure 4:
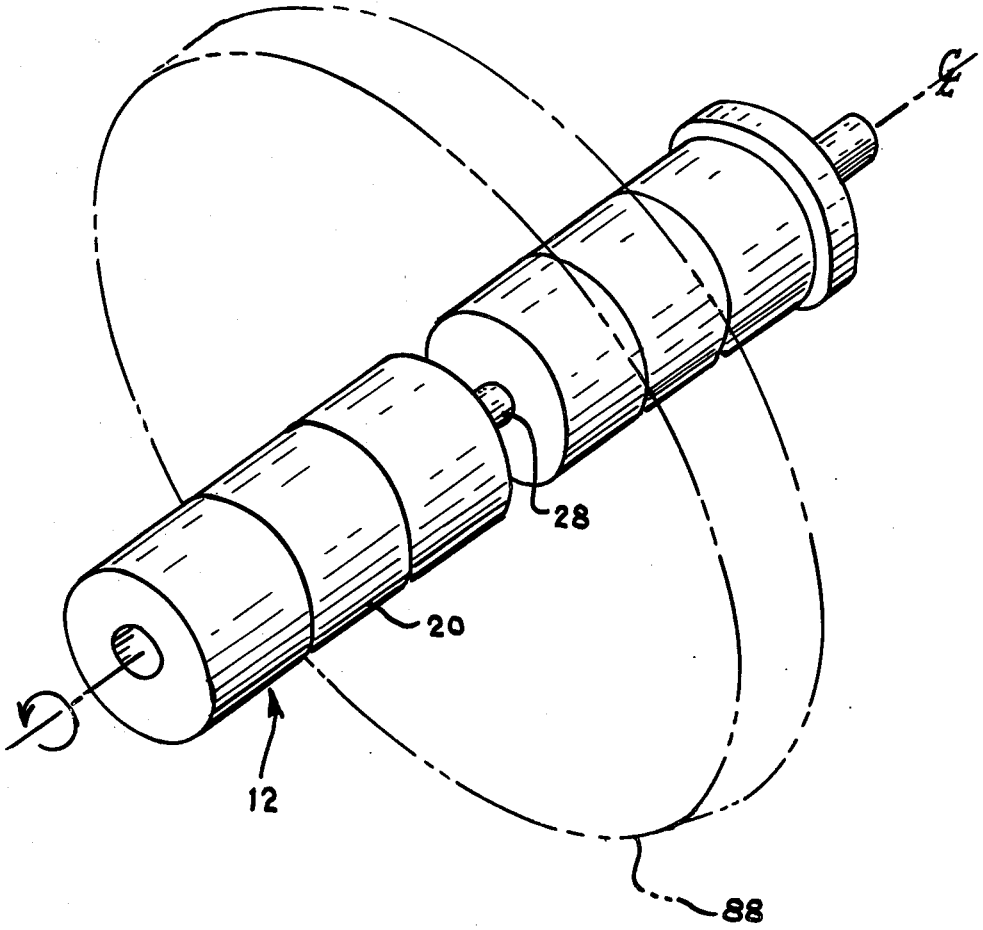
FIG. 4 is a pictorial representation of the centrifugal aerosol dispenser assembly of this invention after being separated from a parent vehicle and in operation.

At a preselected time after release from platform 13, determined by timer 26, actuator 72 moves locking arms in the direction of arrows 76 and thereby releases sides 78. When sides 78 spring free, the aerosol material 88 is dispensed in the manner clearly illustrated in FIG. 4 of the drawing with a velocity $v=rw$, where r is the radius describing the aerosol particle position and w is the angular velocity of the spool housing 80 (i.e., dispenser 12).

The aerosol dispenser assembly 10 is capable of dispensing aerosols slowly at a defined rate and in a known geometrical configuration. The dispenser assembly 10 of the instant invention, through control of the angular velocity and spool housing radius can be tailored to cover a wide range of aerosol dispersal velocities of this invention.

The design of this invention offers the additional advantage that the dispenser compartment 30 may be plugged to provide special tailoring of effective radius from which the aerosol is dispensed. For example, as central shaft 28 in dispenser 12 becomes smaller and the assembly filled with aerosol material, the effective radius from which the aerosol is dispensed will vary from some value approaching zero (the radius of central shaft 28) to the defined maximum radius of compartment 30. The result will be a dispensed cloud characterized by a range of radial velocities and a "thick" annulus. If a plug is inserted in the central portion of the dispenser compartment 30, a more narrow annulus will result. Because the aerosol is dispensed by centrifugal motion, the cloud will always be dispensed as a disc or cylinder.

Although this invention has been described with reference to a particular embodiment, it will be understood to those skilled in the art that this invention is also capable of further and other embodiments within the spirit and scope of the appended claims.

We claim:

1. A centrifugal aerosol dispenser assembly comprising a mount and a dispenser operatively attached thereto, means for ejecting said dispenser from said mount with a spin motion, a first portion of said ejection means connected to said mount, a second portion of said ejection means connected to said dispenser, a plurality of compartments located within said dispenser, at least one of said compartments being made up of an actuator section and a dispensing section, said dispensing section having removable sides thereon, means located within said actuator section for releasably securing said sides to said dispensing section and means located within another of said compartments for activating said releasing means at a preselected time whereby at said preselected time after ejection of said dispenser from said mount, said releasing means releases said sides of said dispensing section and allows the expulsion of the contents of said dispensing section to take place in a predetermined geometrical configuration.

2. A centrifugal aerosol dispenser assembly as defined in claim 1 wherein said second portion of said ejection means comprises means for securing said dispenser to said mount, an inner sleeve fixedly secured to said dispenser and encompassing said securing means, means interposed between said mount and said inner sleeve for exerting a force against said inner sleeve and means for releasing said securing means and thereby permitting said force exerting means to propel said sleeve in conjunction with said dispenser in a direction away from said mount.

3. A centrifugal aerosol dispenser assembly as defined in claim 2 wherein said first portion of said ejection means comprising an outer sleeve fixedly secured to said mount and encompassing said inner sleeve and means interposed between said inner sleeve and said outer sleeve for maintaining alignment between said inner sleeve and said outer sleeve.

4. A centrifugal aerosol dispenser assembly as defined in claim 3 wherein said inner sleeve has a pin mounted on the external surface thereof and said outer sleeve has a spiral groove located on the inner surface thereof, said pin and said groove being in operative engagement with one another in order to impart said spin motion to said dispenser upon ejection of said dispenser from said mount.

5. A centrifugal aerosol dispenser assembly as defined in claim 4 wherein said dispensing section has a cover thereon, said cover having a groove located thereon, one end of said sides of said dispensing section being situated in said groove and the other end thereof being held in position by said means for releasably securing said sides in place.

6. A centrifugal aerosol dispenser assembly as defined in claim 5 wherein said sides of said dispensing section are made of a spring-like material.

7. A centrifugal aerosol dispenser assembly as defined in claim 6 wherein said dispenser further comprises a shaft centrally located therein, said cover being secured to said shaft and thereby holding said dispensing section in place.

8. A centrifugal aerosol dispenser assembly as defined in claim 7 wherein said means for releasably securing said sides of said dispensing section in place are in the form of a plurality of movable arms engaging said other end of said sides.

9. A centrifugal aerosol dispenser assembly as defined in claim 8 wherein said means for securing said dispenser to said mount is in the form of a bolt.

10. A centrifugal aerosol dispenser assembly as defined in claim 9 wherein said outer sleeve is made of a semi-rigid material.

* * * * *